US007887878B2

(12) United States Patent
Kim et al.

(10) Patent No.: US 7,887,878 B2
(45) Date of Patent: Feb. 15, 2011

(54) METHOD OF MANUFACTURING A FINE-PATTERNABLE, CARBON NANO-TUBE EMITTER WITH HIGH RELIABILTY

(75) Inventors: Dae Jun Kim, Daejeon (KR); Yoon Ho Song, Daejeon (KR); Jin Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 546 days.

(21) Appl. No.: 11/944,149

(22) Filed: Nov. 21, 2007

(65) Prior Publication Data

US 2008/0139073 A1 Jun. 12, 2008

(30) Foreign Application Priority Data

Dec. 7, 2006 (KR) ..... 10-2006-0123944

(51) Int. Cl.
*B05D 5/12* (2006.01)

(52) U.S. Cl. ..... 427/77; 427/372.2; 313/310; 313/311; 445/51

(58) Field of Classification Search ..... 445/50, 445/51; 313/310, 311, 495; 427/77, 372.2
See application file for complete search history.

(56) References Cited

U.S. PATENT DOCUMENTS

| | | | | |
|---|---|---|---|---|
| 7,040,948 | B2 | 5/2006 | Mao et al. | |
| 2002/0136682 | A1* | 9/2002 | Yanagisawa et al. | 423/447.2 |
| 2005/0129858 | A1* | 6/2005 | Jin et al. | 427/372.2 |
| 2005/0272342 | A1 | 12/2005 | Chen et al. | |
| 2006/0082278 | A1* | 4/2006 | Lee et al. | 313/311 |
| 2008/0299298 | A1* | 12/2008 | Kim et al. | 427/77 |
| 2009/0284122 | A1* | 11/2009 | Yang et al. | 313/310 |

(Continued)

FOREIGN PATENT DOCUMENTS

CN 1630002 A 6/2005

(Continued)

OTHER PUBLICATIONS

Nam J. W. et. al. "The influence of filler on the emission properties and rheology of carbon nanotube paste", Diamond and Related Materials, Elsevier Science Publishers, Amsterdam, NL, vol. 14, No. 11-12, Nov. 1, 2005, pp. 2089-2093.

*Primary Examiner*—Nimeshkumar D Patel
*Assistant Examiner*—Mary Ellen Bowman
(74) *Attorney, Agent, or Firm*—Rabin & Berdo, P.C.

(57) ABSTRACT

A method of manufacturing a carbon nano-tube (CNT) emitter includes the steps of: (a) dispersing a CNT powder, an organic binder, a photosensitive material, a monomer, and a nano-sized metal particle in a solvent to manufacture a CNT paste; (b) coating the CNT paste onto an electrode formed over a substrate; (c) exposing the CNT paste coated on the electrode to thereby perform fine-patterning; (d) plasticizing the finely patterned CNT paste; and (e) processing a surface of the CNT paste such that the surface of the plasticized CNT paste is activated, wherein step (d) includes a first plasticizing step performed in an air atmosphere; and a second plasticizing step performed in a vacuum or inactive gas atmosphere. Improved uniformity of electron emissions in a field emission device is achieved and a plurality of CNT emitter regions are formed within a single pixel.

11 Claims, 4 Drawing Sheets

U.S. PATENT DOCUMENTS

2010/0079051 A1* 4/2010 Kim et al. ..... 313/311

FOREIGN PATENT DOCUMENTS

| | | | |
|---|---|---|---|
| CN | 1694207 | A | 11/2005 |
| EP | 1553613 | A2 | 7/2005 |
| JP | 2004-234865 | | 8/2004 |
| JP | 2005-183370 | A | 7/2005 |
| KR | 2001-0107272 | A | 12/2001 |
| KR | 20050023016 | | 3/2005 |
| KR | 20050087265 | | 8/2005 |
| KR | 2006-0000144 | | 1/2006 |
| KR | 2006-0096561 | | 9/2006 |
| WO | WO-01/99146 | A2 | 12/2001 |
| WO | WO-2007/066932 | A1 | 6/2007 |

* cited by examiner

METHOD OF MANUFACTURING A FINE-PATTERNABLE, CARBON NANO-TUBE EMITTER WITH HIGH RELIABILTY

CROSS-REFERENCE TO RELATED APPLICATION

This application claims priority to and the benefit of Korean Patent Application No. 2006-123944, filed Dec. 7, 2006, the disclosure of which is incorporated herein by reference in its entirety.

BACKGROUND

1. Field of the Invention

The present invention relates to a method of manufacturing a fine-patternable carbon nano-tube (CNT) emitter for a field emission device (FED) with high reliability, and more particularly, to a method of manufacturing a CNT emitter which employs a CNT paste including a nano-sized metal particle, an organic binder, a photosensitive material and a monomer, and a fine-patterning process to manufacture the CNT emitter.

2. Discussion of Related Art

A physical function of a field emission device (FED) is principally the same as that of a cathode ray tube (CRT) except for an electron emission source of the CRT that is formed of a cold cathode material. In the FED, an electric field is applied to a field emitter having an ultra-fine structure and an electron emitted into vacuum hits a fluorescent medium (i.e., exciting the fluorescent medium) so that an image is displayed. Therefore, the FED is a display device that has excellent display characteristics of the CRT, and can be lightweight and thin. Also, since the FED has ideal characteristics of a display device in all aspects, it has come into the spotlight as a promising next generation flat panel display.

A material that has recently gained attention as an electron emission source (emitter) of the FED is a carbon nano tube (CNT). The CNT is an emitter that applies the principle of field emission, in which an electron is emitted when an electric field is applied to a conductive emitter having a sharp end in a vacuum state, and provides excellent performance.

FIG. 1 is a side cross-sectional view of a conventional FED including a CNT emitter. FIG. 2 is an enlarged cross-sectional view of region II of FIG. 1.

Referring to FIG. 1, an FED 100 includes an electron emitter 110 in which an electron emission source is formed as an emitter 114, and an image generating part 130 including fluorescent layers 135 in which an electron emitted from the electron emitter 110 is hit to thereby generate light.

The image generating part 130 includes a second substrate 131, a positive electrode 133 (anode) formed on the second substrate 131, the fluorescent layers 135 formed spaced apart from each other on the positive electrode 133, and a light-shielding layer (black-matrix) 137 formed between the fluorescent layers 135. The light-shielding layer 137 is in charge of defining pixel boundaries.

The electron emitter 110 includes a first substrate 111, negative electrodes (cathodes) 113 formed spaced apart from each other on the first substrate 111 in a predetermined shape, a CNT emitter 114 formed on the negative electrode 113 using a CNT, and a gate electrode 119 that is insulated from the negative electrode 113. An insulating layer 118 is formed below the gate electrode 119. A spacer 140 supporting the electron emitter 110 and the image generating part 130 is formed between the electron emitter 110 and the image generating part 130.

To manufacture the CNT emitter 114 that constitutes the electron emitter 110, a CNT paste should first be manufactured. The CNT paste is manufactured by: (1) dispersing the CNT and an inorganic filler; (2) adding an organic binder; and (3) mixing the addition using a solvent and adjusting viscosity. Referring to FIG. 2, after the CNT paste is manufactured through processes (1) to (3), the CNT paste is coated on the negative electrode 113 of the electron emitter 110 to thereby form the CNT emitter 114.

However, when the CNT emitter 114 is manufactured using the above-described CNT paste, the conventional CNT paste employs a frit glass generally having a size of several μm as an inorganic (metal) filler 115. In this case, the frit glass has physically and chemically different characteristics from the CNT. Therefore, it is difficult to equally distribute the CNT that will be implemented as an emitter. Also, adhesion between the cathode 113 and the CNT 117 is not uniform. Furthermore, a resistance between the negative electrode 113 and the CNT 117 or one CNT 117 and another CNT 117 is considerably increased or is non-uniformly exhibited, and thus this presents an obstacle to the accomplishment of a function of the FED.

Since the CNT emitter 114 is formed above the negative electrode 113 without strong adhesion, when the CNT emitter 114 generates an intense electric field, the CNT emitter 114 may become detached from the negative electrode 113. As a result, a contact resistance between the CNT emitter 114 and the negative electrode 113 may be non-uniform or increased. Also, since only a part of the CNT emitter 114 contributes to the electron emission, beginning with deteriorated electron emission characteristics, a deteriorated electron emission site and non-uniform distribution of the electron emission appear. Furthermore, since only a part of the CNT emitter 114 is responsible for the electron emission, the life span of the CNT emitter 114 may be significantly reduced. Fine patterning that is required not only for the manufacturing of fine pixels suitable for high resolution but for improvement of the non-uniform electron emission is difficult to implement due to obstacles involved in a printing process.

To overcome these problems, other methods of manufacturing a CNT paste are disclosed in Korean Patent Application No. 2006-84912 (Applicant: Electronics and Telecommunications Research Institute). In the method, a nano-sized metal particle that can be melted at a low temperature where a CNT does not deteriorate is added so that adhesion through melted metal between a CNT emitter and a negative electrode can be improved, and a resistance between the electrode and the CNT and between respective CNTs can be reduced. At the same time, a uniform resistance is applied so that the electron is uniformly emitted and the density of an active emission site contributing to the electron emission is increased. As a result, a CNT that can obtain considerable reliability may be manufactured.

Based on the method, an improved CNT for an FED may be implemented. However, the manufacturing of the fine pixels suitable for the high resolution and implementation of the fine-patterning for forming a plurality of CNT emitter regions within a pixel require strengthened patterning characteristics by exposure of the paste. In a case of a photosensitive material required for the patterning by the exposure, a monomer that reacts thereto and an organic binder, when they do not completely burn-out after the plasticity, a work function for the electron emission in the CNT and out-gassing in vacuum are increased by an organic material remaining on a surface of the CNT. As a result, characteristics of the CNT emitter deteriorate.

However, when a plasticity temperature that is higher than a melting point of the nano-sized metal particle that is added into the CNT paste is applied for the sake of the burn-out of the organic material as above, a metal layer that is melted first at a low temperature and holds the CNT is damaged in the process of the burn-out of the organic material. As a result, a surface shape of the CNT emitter deteriorates, so that characteristics of the CNT emitter eventually deteriorate as well.

SUMMARY OF THE INVENTION

The present invention is directed to a method of manufacturing a fine-patternable carbon nano-tube (CNT) emitter having high reliability, into which a nano-sized metal particle that is melted at a low temperature at which a CNT does not deteriorate is added, and simultaneously, a CNT paste that improves photosensitive characteristics of the fine-patterning required for manufacturing of fine pixels suitable for high resolution or improvement of uniformity of electron emission is used.

One aspect of the present invention provides a method of manufacturing a CNT emitter including the steps of: (a) dispersing a CNT powder, an organic binder, a photosensitive material, a monomer, and a nano-sized metal particle in a solvent to manufacture a CNT paste; (b) coating the CNT paste onto an electrode formed over a substrate; (c) exposing the CNT paste coated on the electrode to thereby perform fine-patterning; (d) plasticizing the finely patterned CNT paste; and (e) processing a surface of the CNT paste such that the surface of the plasticized CNT paste is activated.

In step (c), the CNT paste may be patterned to a fine size of 5 μm×5 μm, which is a minimum limit where adhesion to the electrode of the CNT emitter may be maintained. The monomer that is a material added for the sake of the exposure and for the fine-patterning reacts with the photosensitive material to thereby polymerize the organic binder. The monomer may be added at 1/100 to 1/10 of the organic binder by weight. Also, the photosensitive material may be added at 1/100 to 1/10 of the organic binder by weight. A weight ratio (wt %) of the CNT powder to the metal particle may be 1:2 to 1:3.

Step (d) may include at least one of a plasticity process performed at a temperature of about 250 to 300° C. in an air atmosphere, and a plasticity process performed at a temperature of about 320 to 450° C. in a vacuum or inactive gas (Ar, $N_2$, etc) atmosphere. Step (e) may be performed by a rolling process such that an adhesive agent is not stuck.

Step (a) may include the steps of: dispersing the CNT powder in a solvent; adding the organic binder into a dispersion solution into which the CNT powder is mixed; performing a milling process to adjust viscosity of the dispersion solution into which the organic binder is mixed; adding the nano-sized metal particle; and adding the photosensitive material and the monomer into the dispersion solution. The metal particle may be added in the form of powder or paste. The metal particle may include a metal having high conductivity such as Ag, Cu, Ru, Ti, Pd, Zn, Fe or Au.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF EXEMPLARY EMBODIMENTS

Hereinafter, exemplary embodiments of the present invention will be described in detail. However, the present invention is not limited to the embodiments disclosed below, but can be implemented in various forms. Therefore, the following embodiments are described in order for this disclosure to be complete and enabling to those of ordinary skill in the art.

Figure 3:
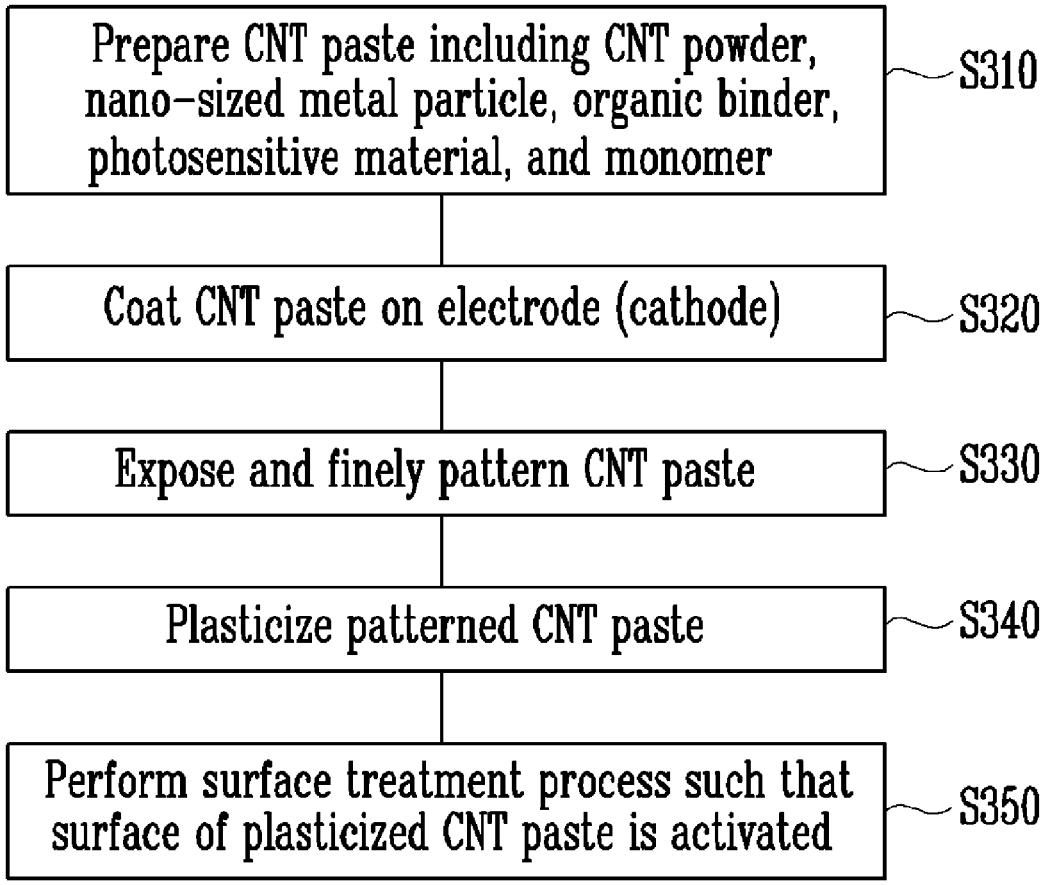
FIG. 3 is a block diagram illustrating a method of manufacturing a CNT emitter according to an exemplary embodiment of the present invention.
Figure 4A:
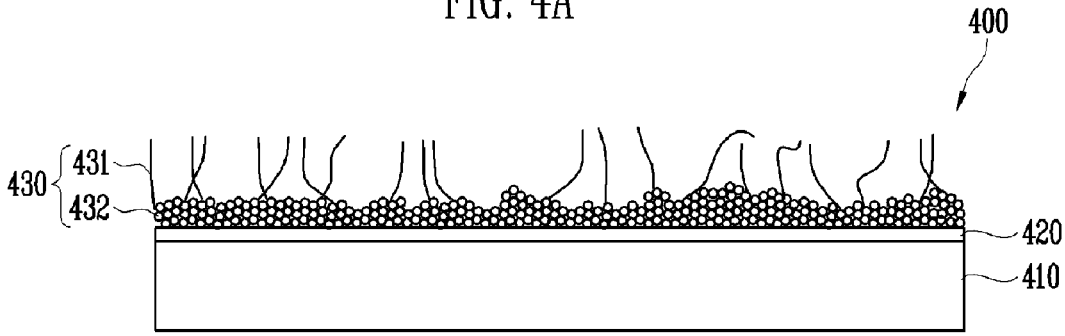
FIG. 4A is a cross-sectional view illustrating the state in which a CNT paste having a nano-sized metal particle added thereto is coated on a substrate according to an exemplary embodiment of the present invention.
Figure 4B:
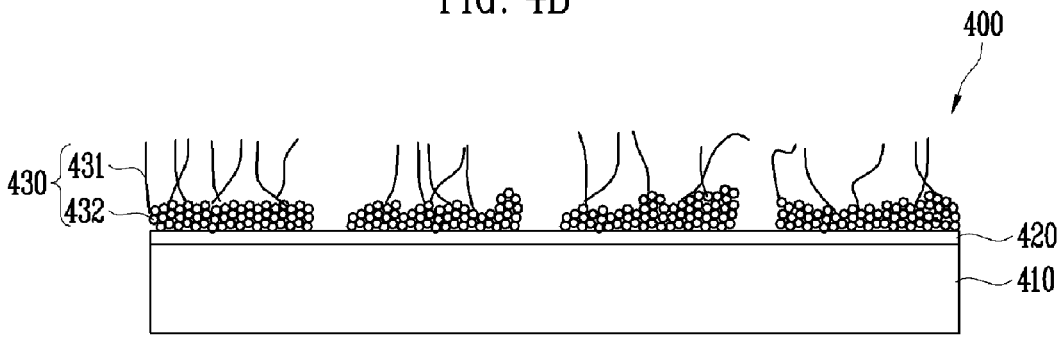
FIG. 4B is an enlarged cross-sectional view schematically illustrating a CNT emitter in which the CNT paste of FIG. 4A is exposed and patterned.
Figure 4C:
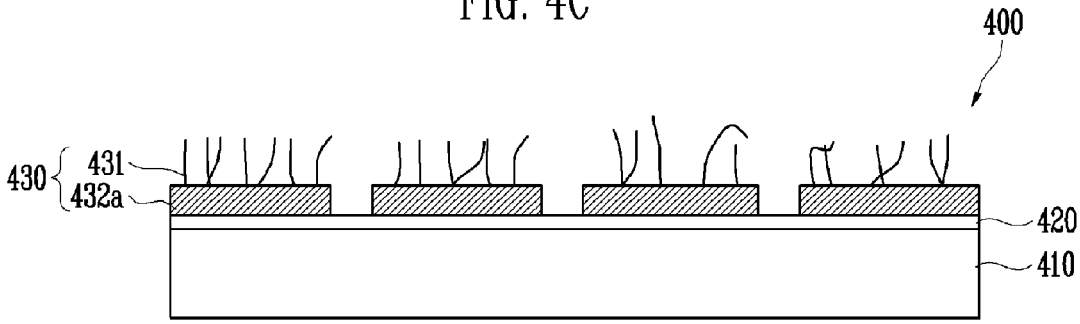
FIG. 4C is an enlarged cross-sectional view of a plasticized CNT after the patterning of FIG. 4B.

FIG. 3 is a block diagram illustrating a method of manufacturing a carbon nano-tube (CNT) emitter according to an exemplary embodiment of the present invention. FIG. 4A is a cross-sectional view illustrating the state in which a CNT paste having a nano-sized metal particle added thereto is coated on a substrate according to an exemplary embodiment of the present invention. FIG. 4B is an enlarged cross-sectional view of a CNT emitter after the CNT paste of FIG. 4A is exposed and patterned. FIG. 4C is an enlarged cross-sectional view of a CNT emitter after the patterning of FIG. 4B is performed and a plasticity process is completed.

Referring to FIG. 3, first, to manufacture an emitter formed in an electron emitter 400 using a CNT paste 430, the CNT paste including a CNT powder, a nano-sized metal particle, an organic binder, a photosensitive material, and a monomer are prepared (S310).

The metal particle that constitutes the CNT paste may be formed of an ohmic contactable and high-conductive metal such that an interfacial resistance between one CNT and another CNT, and an interfacial resistance between a CNT and a cathode electrode 420 in a CNT emitter formed of the CNT paste 430 are lowered. The high-conductive metal that may be used for the CNT paste may include Ag, Cu, Ti, Ru, Pd, Zn, Au and Fe. These metals may be individually used or appropriately mixed together to be used. Various metals are mixed to thereby form a nano-sized metal particle, so that adhesive and electrical characteristics can be improved.

Meanwhile, the metal particle has a size of 1 to 10 nm so that it may be melted at a lower temperature than the temperature at which thermal damage is caused to the CNT powder, and may be added in the form of powder or paste. When the metal particle is in the form of powder, it is dispersed when the CNT powder is dispersed in a solvent. When the metal particle is in the form of paste, it is added during a milling process that is a post-process performed to adjust viscosity of the dispersion solution.

Each of the CNT powder and the nano-sized particle may be dispersed in almost any kind of solvent (aqueous solvent, organic solvent, etc.). Generally, since nano materials such as a CNT have characteristics of recombination (aggregation) after a predetermined time lapse following the dispersion, a solvent that has excellent interfacial active characteristics may be used. In addition, a solvent having a high vaporization temperature (a solvent having a boiling point of about 150° C. or higher) may be additionally used to prevent rapid evaporation. In the present embodiment, the CNT powder and the nano-sized metal particle are dispersed using Isopropyl Alcohol (IPA), Terpineol, etc., which have excellent interfacial active characteristics. When a dispersion solvent into which IPA and Terpineol are mixed is used, only the Terpineol remains after the CNT paste is manufactured. This is because the IPA used for the dispersion of the CNT is dried after the dispersion of the CNT is completed. A boiling point of the Terpineol remaining after the manufacturing of the CNT paste is 120 to 170° C.

Furthermore, when the CNT paste is manufactured, the used CNT powder and nano-sized metal particle should be mixed at a proper ratio taking into account a shape of the CNT to be manufactured using the same. In the present embodiment, the composition ratio of the CNT powder to the metal particle is 1:2 to 1:3 in terms of percent by weight (wt %).

In the step of patterning the CNT paste that is a post-process (S330), to determine characteristics of the fine-patterning, an organic binder, a photosensitive material and a monomer should be added into the dispersion solution into which the CNT powder and the nano-sized metal particle are dispersed. Polymers that have various kinds of molecular weights and characteristics may be used individually or in combination as an organic binder that is added into the dispersion solution. A kind of acryl resin (or ethyl cellulose) that exhibits excellent reactivity with a monomer is generally used for the organic binder. The photosensitive material (a photo-initiator) is a material that instructs the monomer to react when receiving light, and may be selected depending on the types of added organic binder. In particular, a material matching the organic binder may be selected as the photosensitive material.

The monomer is a material that is added to obtain fine-patterning characteristics by exposure. The monomer acts to cause a reaction by the photosensitive material to thereby polymerize with the polymer. The photosensitive material should be optimized by a proper weight ratio with the monomer and the organic binder. When the ratio is not correct, performing the fine-patterning may be impossible, and it may have an effect on the shape of the final CNT emitter as well. Therefore, the photosensitive material is added at 1/10 to 1/100 of the organic binder by weight, and the monomer is added at 1/10 to 1/100 of the organic binder by weight. When the photosensitive material is mixed into the CNT paste at an optimal ratio as above, the CNT paste that is coated on the substrate or the electrode may be formed to a fine-pattern having a particular shape or a fine-pattern of several μm or less through a photosensitive reaction. Moreover, the milling process is employed to adjust the viscosity of the dispersion solution where the organic binder, the photosensitive material, and the monomer are added. As described above, when the metal particle is in the form of paste, the metal particle is added into the dispersion solution during the milling process.

When the manufacturing of the CNT paste is completed (S310), as illustrated in FIGS. 3 and 4A, the CNT paste 430 is coated on the electrode (cathode) 420 formed on the substrate 410 of the FED (S320). As illustrated, the CNT paste 430 is coated on the entire surface of the cathode electrode 420, and includes a CNT 431 and a filler 432. When the CNT paste 430 is coated on the cathode electrode 420, a screen printing process or a spin coating process may be applied depending on the viscosity.

Referring to FIGS. 3 and 4B, in the next step, the CNT paste 430 coated on the cathode electrode 420 is exposed and patterned along with a desired pattern (S330). Since the CNT paste 430 includes the photosensitive material, it can be selectively exposed according to the desired pattern layout. As described above, when the exposure process is selectively performed, and then the patterning process is performed, a fine patterning of about 5 μm×5 μm is possible. Therefore, a plurality of CNT emitters may be formed within a single pixel.

Referring to FIGS. 3 and 4C, after the CNT paste 430 is patterned, plasticizing the patterned CNT paste 430 is performed (S340). The step of plasticizing the CNT paste 430 (S340) includes a first plasticity process that is performed at a temperature of about 250 to 300° C. in an air atmosphere, and a second plasticity process that is performed at a temperature of about 320 to 450° C. in a vacuum or inactive gas atmosphere (Ar, $N_2$, etc.). The first plasticity process enables the burning-out of the organic binder included in the CNT paste 430, and the metal particle to be melted depending on the type of a metal particle. Under the above-described conditions (in the vacuum atmosphere, and at a temperature ranging from 320 to 450° C.), the final removal process of an organic compound remaining on a surface of the CNT in addition to the melting of the metal particle are performed in the second plasticity process.

When the burning-out of the organic binder and melting of the metal particle are performed after the plasticity process (S340), the finely patterned CNT emitter is firmly adhered onto the cathode electrode 420, as illustrated in FIG. 4C. In the next step, a surface treatment process is performed so that the surface of the patterned CNT emitter is activated (S350). While plasma processing, high electric field processing, taping processing, rolling processing, etc. may be variously applied for the surface treatment process, employing the rolling process in which a problem of outgassing in vacuum is removed, glue is not stuck, and a manufacturing process is simple may be desirable.

Figure 1:
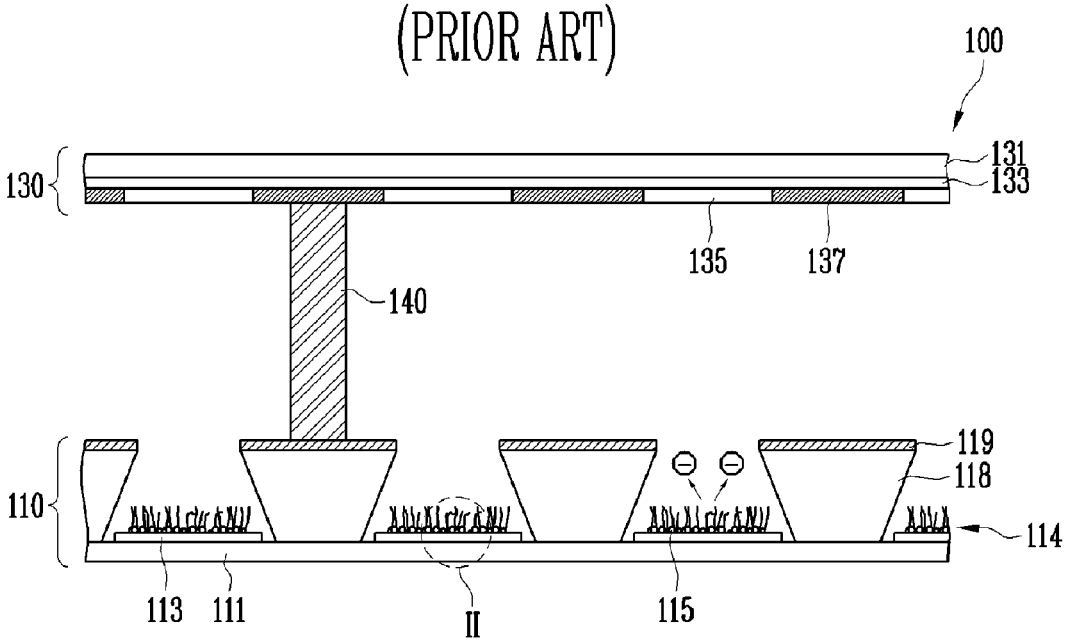
FIG. 1 (PRIOR ART)
FIG. 1 is a side cross-sectional view of a conventional field emission device (FED) including a carbon nano-tube (CNT)
Figure 2:
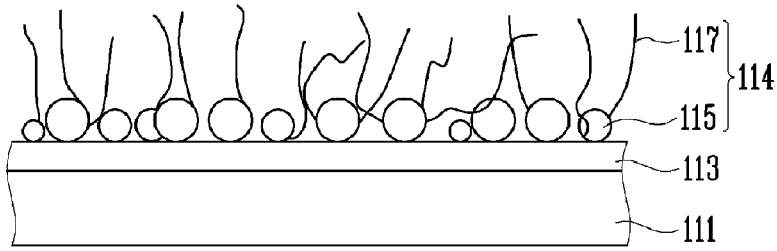
FIG. 2 (PRIOR ART)
FIG. 2 is an enlarged cross-sectional view of region II (an emitter region) of FIG. 1.

Unlike the conventional CNT emitter illustrated in FIG. 2, in the finely patterned CNT emitter manufactured according to the above-described manufacturing processes, a nano-sized metal particle 432*a*, and the nano-sized CNT 431 are evenly dispersed. Also, in the finely patterned CNT emitter, a user may form a desired pattern and a selective pattern. Moreover, contact between one CNT and another CNT may be uniformly formed by the melted metal, and the FED including the CNT emitter that has improved electron emission characteristics may be manufactured through the final physical surface treatment process. In particular, when the CNT emitter is manufactured through the above manufacturing processes, adhesive characteristics are much improved compared to a case adhered to by the metal filler. Also, as the adhesive characteristics are improved, electrical resistance is reduced, and uniformity of the resistance is improved.

Figure 5:
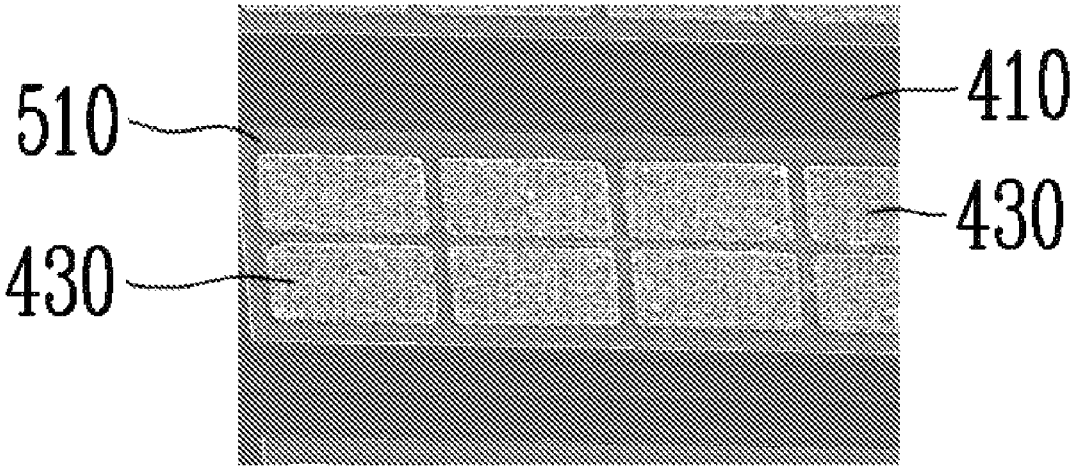
FIG. 5 is an enlarged scanning electron microscope (SEM) image of a finely patterned CNT emitter manufactured according to an exemplary embodiment of the present invention.

FIG. 5 is an enlarged scanning electron microscope (SEM) image illustrating a finely patterned CNT emitter manufactured according to an exemplary embodiment of the present invention.

Referring to FIG. 5, it can be confirmed that the CNT emitters manufactured using a plurality of CNT pastes 430 are formed within one pixel 510 formed on the substrate 410. The CNT emitter may be implemented to have a fine configuration depending on the shape that a user desires, and as a result, it may be suitable for manufacturing a cathode for the FED suitable for high resolution.

According to the above, since density of an activity emitting site contributing to electron emission is increased by fine-patterning characteristics of a CNT emitter according to the present invention, an FED having high resolution and high image quality emphasizing reliability can be provided.

The CNT emitter according to the present invention may improve adhesion of the CNT emitter with a melted metal due to a low melting temperature of a nano-sized metal particle without deterioration of a CNT in the process of forming the CNT emitter. Also, since the CNT emitter is evenly mixed into a conductor having excellent conductivity by the melted metal, electrons are uniformly emitted in the CNT emitter according to the present invention. In addition, the CNT emitter and the metal particle are not separated from a cathode.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of manufacturing a carbon nano-tube (CNT) emitter, comprising the steps of:

(a) dispersing a CNT powder, an organic binder, a photosensitive material, a monomer, and a nano-sized metal particle in a solvent to manufacture a CNT paste;

(b) coating the CNT paste onto an electrode formed over a substrate;

(c) exposing the CNT paste coated on the electrode to thereby perform fine-patterning;

(d) plasticizing the finely patterned CNT paste; and (e) processing a surface of the CNT paste such that the surface of the plasticized CNT paste is activated, wherein step (d) comprises:

a first plasticizing step performed in an air atmosphere; and second plasticizing step performed in a vacuum or inactive gas atmosphere.

2. The method according to claim 1, wherein in step (c), the CNT paste is finely patterned to a size of about 5 μm×5 μm.

3. The method according to claim 1, wherein the monomer is a material that reacts with the photosensitive material to polymerize with the organic binder so that the CNT paste may he finely patterned during exposing.

4. The method according to claim 3, wherein the monomer is added in a weight ratio of monomer to organic hinder ranging from 1/100 to 1/10.

5. The method according to claim 3, wherein the photosensitive material is added in a weight ratio of photosensitive material to organic hinder ranging from 1/100 to 1/10.

6. The method according to claim 1, wherein the CNT paste has a weight ratio of the CNT powder to the metal particle ranging from 1:2 to 1:3.

7. The method according to claim 1, wherein step (d) comprises at least one of:

the first plasticizing step performed at a temperature of about 250 to 300° C. in an air atmosphere; and the second plasticizing step performed at a temperature of about 320 to 450° C. in a vacuum or in an inactive gas atmosphere.

8. The method according to claim 1, wherein in step (e), a rolling process is performed so that an adhesive agent is not stuck.

9. The method according to claim 1, wherein step (a) comprises the steps of in the order recited:

dispersing the CNT powder in the solvent;

adding the organic binder into the dispersion of the CNT powder in the solvent and mixing to form a dispersion-solution;

performing a milling process to adjust viscosity of the dispersion-solution;

adding the nano-sized metal particle; and adding the photosensitive material and the monomer into the dispersion-solution.

10. The method according to claim 9, wherein the metal particle is added as a powder or as a paste.

11. The method according to claim 10, wherein the metal particle comprises at least one of Ag, Cu, Ru, Ti, Pd, Zn, Fe and Au.

* * * * *